United States Patent [19]

Camus

[11] Patent Number: 4,618,402

[45] Date of Patent: Oct. 21, 1986

[54] SAFETY MEANS, PAPER AND DOCUMENT AGAINST FALSIFICATION BY CHEMICAL AGENT

[75] Inventor: Michel Camus, Charavines, France

[73] Assignee: Arjomari-Prioux, Paris Cedex, France

[21] Appl. No.: 758,361

[22] Filed: Jul. 24, 1985

[30] Foreign Application Priority Data

Aug. 10, 1984 [FR] France ..... 84 12704
Apr. 12, 1985 [FR] France ..... 85 05574

[51] Int. Cl.[4] ..... D21H 5/10

[52] U.S. Cl. ..... 162/140; 162/158; 162/168.1; 162/181.2; 428/199; 428/915; 428/916

[58] Field of Search ..... 162/140, 158, 181.2, 162/181.3, 181.4, 168.1, 175; 427/7; 428/199, 915, 916

[56] References Cited

U.S. PATENT DOCUMENTS

| | | | |
|---|---|---|---|
| 2,186,810 | 7/1940 | Simons | 162/140 |
| 2,378,585 | 6/1945 | Schroth | 162/140 |
| 2,379,443 | 7/1945 | Kantrowitz | 162/140 |

*Primary Examiner*—Peter Chin
*Attorney, Agent, or Firm*—Bacon & Thomas

[57] ABSTRACT

The paper according to the invention contains a non-fluorescent means against chemical falsification, reacting to the oxidizing agent/reducing agent couple. The paper according to the invention contains iron(III) and a product giving a complex colored with iron(II). Any attempt to falsify by chemical means provokes the reduction of the iron(III) into iron(II) immediately followed by the formation of the colored complex. According to the invention, the complexing agent is preferably 2,2-bipyridyl. Another complexing agent is orthophenantroline.

20 Claims, No Drawings

SAFETY MEANS, PAPER AND DOCUMENT AGAINST FALSIFICATION BY CHEMICAL AGENT

The present invention relates to a safety means, particularly for paper, reacting to falsification by chemical agent.

It concerns the domain of safety papers which may be used in particular for making hand-written pieces for payment and official documents such as cheques, paper money, Savings Certificates, books, accounts, stocks, stamped paper, Notary's deeds, and, in particular, all safety papers and comparable safety means such as credit cards, etc. . . . for which it is indispensable to provide against any falsifications of the writing or seal borne on the papers by means of chemical reagents which cleanly eliminate the coloured inks presently used for handwriting or printing by inking pads.

Known safety papers may, in addition to the watermark and other physical safety elements, such as threads, fibers, etc. . . . , contain certain reagents contributing a sensibilization to the chemical agents which may be used for falsifying the writing by chemically decolorizing the inks. For example, papers have already been proposed which contain chemical reagents to acids, to alkalis, to chlorinated bleaching reagents such as chlorine water and Javel water, to ink erasers (French Patent Nos. 2 365 656, 2 399 505, 2 402 739 to ARJOMARI, French Patent No. 2 406 027 to Papeteries de VOIRON et des Gorges) and to the reducing oxidizing agents used in the erasers of the "CORECTOR" or "SLOAN'S" type (Registered Trademarks).

However, the protection of the paper against falsification by reducing oxidizing agents has, up to the present time, essentially employed fluorescent products. Such fluorescence is a handicap and limits the safety of these papers, for which the non-fluorescence is a sign of recognition very often used, particularly in banks and by the general public. In fact, it is known that papers, particularly for printing-writing, are virtually always fluorescent, the fluorescence being due to additives improving the whiteness of the paper. Being given that it is very difficult to find non-fluorescent printing-writing paper, the counterfeiters, unless they can obtain non-fluorescent paper by fraud, will have every chance of using a fluorescent paper. A non-fluorescent paper therefore constitutes a very effective prevention against counterfeit and, when such paper which has been rendered non-fluorescent, is worked, it is obviously essential that the safety agents incorporated in the paper do not contribute per se the characteristic of fluorescence which was able to be avoided.

In the domain covered by the invention, it is therefore absolutely indispensable that the safety agent be non-fluorescent.

U.S. Pat. No. 2,186,810 discloses a process employing a non-fluorescent product, which consists in using orthophenantroline or 2,2'-bipyridyl present in the paper to generate an indelible trace during the act of writing with inks containing iron(II) and/or nickel and/or cobalt by complexing of these metals. However, this process presents the drawback of being effective only for special inks and therefore of not sensibilizing the paper against any attempt of falsification by means of chemical agents having a bleaching power on the inks used.

An object of the invention is to obtain a non-fluorescent safety paper reacting, not to the inks, but to the oxidizing agent/reducing agent couple allowing protection against falsification and which comprises on its surface or in its mass a chemical composition adapted to sensibilize the paper with respect to the oxidizing agent/reducing agent couples, not appreciably modifying the coloration of the paper and compatible with the known reagents of sensibilization to acids, bases, organic solvents and erasers.

A safety agent has been sought which responds simultaneously to all the following criteria:

being able to be incorporated in the paper whilst the conventional paper-making techniques are being carried out, simply and conveniently, not being fluorescent, not appreciably coloring the paper, not increasing exorbitantly the cost of the paper, being sufficiently retained in the sheet during formation of the sheet and during the passage thereof in the paper-making machine, reacting to the oxidizing agent/reducing agent couple, with a sufficiently high sensitivity to satisfy the severe tests existing in that domain.

The complexity of such a search will be apparent if it is considered that experimentation made on the families known for their chromogenic properties under the severe conditions of the test cited hereinafter in Example 1, has not given satisfactory results. For example, the following means have proved unusable in practice:

(a) reduction of an iodate to form a coloured iodide:

this system employs dangerous metals, for example mercury, problem of stability of the iodate.

(b) oxidation of a lead salt to yield a red lead oxide:

this system also employs lead which is toxic by accumulation (problem of industrial rejects).

(c) reduction of azoxy derivative leading to coloured azo products:

molecules corresponding to this system and synthesized especially by Applicant have not given the expected reactions.

After intensive and prolonged trials, Applicant finally found that the object of the invention could be attained by a means comprising a sensibilization agent giving a complex coloured with iron(II), and by the fact that the paper contains, on the surface or in the mass, iron(III) capable of being reduced to iron(II) by the chemical reducing agent for falsification, and a means preventing the reduction of the iron(III) into iron(II) by the other constituents of the paper.

The choice of the sensibilization agent is made as a function of the colouring power of the initial product and of its reactivity with respect to the oxidizing agent/reducing agent couple.

These sensibilization agents are either colourless or slightly coloured under the conditions of production of the paper and do not cause the latter substantially to lose its qualities of whiteness at their dose of application.

On the other hand, if these complexing agents form complexes with the iron(III) present in the paper, these complexes are either colourless, or slightly coloured under the conditions of production of the paper and do not cause the latter substantially to lose its qualities of whiteness at their dose of application.

Finally, once the iron(III) is reduced into iron(II), these sensibilization agents must form a complex coloured with the iron(II).

The man skilled in the art can select the usable compounds without difficulty by means ofthe teachings and criteria furnished hereinabove.

To obtain a white or virtually white non-fluorescent paper according to the invention, offering a reaction to the oxidizing agent/reducing agent couple, the sensibilization derivative may in particular be 2,2'-bipyridyl which forms a red complex with iron(II).

Another sensibilization compound is orthophenantroline which, however, presents the drawback of being expensive.

The role of the means preventing the reduction of the iron(III) into iron(II) by the other constituents of the paper will be more readily understood on reading the following explanations.

Applicant has observed, during trials on papers sized with starch and comprising chemical compounds such as iron(III) and 2,2'-bipyridyl or orthophenantroline, a progressive coloration in time in the absence of any attempted chemical falsification.

Tests on sheets exempt of sizing with starch have enabled safety papers to be obtained which are stable in time.

The starch added to the paper during the secondary treatment of the sheet by means in particular of a size-press is at the origin of this progressive coloration in time.

This coloration is essentially due to the reducing power of the starch which converts the iron(III) into iron(II) and thus promotes the formation of the coloured complex between the iron(II) and the complexing agent.

This is why the present invention proposes two modes of producing unfalsifiable papers stable in time, made under the following conditions of sizing:

(A) Conventional sizing of the safety paper with the aid of a sizing agent used in paper-making not reducing the iron(III), such as in particular polyvinyl alcohol (PVA), itself constituting said means preventing the reduction of iron(III) into iron(II), or (B) Conventional sizing of the paper with the aid of a sizing agent used in paper-making, reducing the iron(III), such as starch, this sizing agent having to be associated with an oxidizing agent stronger than the iron(III) which constitutes said means.

In this way, when the paper sizing agent is an agent reducing the iron(III), such as starch, an essential feature of the invention is the incorporation in the impregnation bath of an oxidizing agent stronger than the iron(III). This oxidizing agent serves as oxidizing reserve with respect to the starch introduced in the paper.

This oxidizing agent must be stable under the conditions of production of the paper, and in particular must be stable in water and must not colour the paper.

Certain oxidizing agents are to be avoided, in particular:

the iodates which, oxidized by the air, yield coloured iodides, the chlorates due to the risks of explosion run during manufacture, the borates due to the cost thereof.

The man skilled in the art can:

select the suitable oxidizing agents from the criteria furnished hereinabove and from the tables of electrochemical potentials available in scientific literature, determine the quantity of oxidizing agent necessary for blocking the parasitic reactions and constituting an oxidizing reserve.

The paper comprising such a safety means according to the invention has a good whiteness. If attempts are made to eliminate the writing in ink on this paper with the aid of an eraser of the "CORECTOR" type, mixture of bisulfite or the like, a coloured trace appears in their place which betrays the falsification.

Whatever the type of sizing chosen (A or B), this paper may have any fibrous composition, purely cellulosic, partly synthetic, from synthetic fibers or coated synthetic films, referred to more briefly hereinafter as "paper", to which may be added the conventional additives used in paper-making, namely: inorganic fillers, various resistance agents, binding agents, resins, shading dyes, neutral, acid or basic sizing products, alumina sulfate for acid sizing or adjustment of the pH, etc. . .

To the preceding mixture may also be added sensibilization reagents similar to those already used at the present time in safety papers; for example, products ensuring a modification of the appearance of the paper by contact thereof with acids, bases, erasers, organic solvents or certain oxidizing agents such as Javel water (sodium hypochlorite).

The introduction of the reagents according to the invention may essentially be effected in three different manners:

in the mass of the cellulosic paper or partly or totally synthetic paper, by impregnation, by means of a size-press or off-machine, of cellulosic papers, or partly or totally synthetic papers, by coating of all types of papers, the additive according to the invention then being contained in the or each coating layer.

The quantities of reagents to be used according to the invention will be calculated for reasons of cost as a function of the necessary quantities of complexing agent which will be made to react in toto, as far as possible.

The quantities of agents according to the invention (in % per weight) are:

Quantity for observation of a coloration which begins to be visible to the eye: 0.015% by dry weight of 2,2'-bipyridyl with respect to the weight of paper associated with at least its stoichiometric quantity of iron(III).

Maximum quantity: fixed by the overcosts envisaged or the modifications of characteristics of the paper, in manner known to the man skilled in the art.

Industrially, 0.045% by dry weight of 2,2'-bipyridyl with respect to the weight of the paper is currently introduced.

The reagents are introduced either in aqueous solution, in which case it must be ensured that they are retained on the fibers by direct bond or via fixation agents or binding agents, in the precipitated, micro-dispersed or pigmentary state.

These papers may also contain in their mass, in the dispersed pigmentary state, dyes insoluble in water but organo-soluble, so as to preserve the writing or mentions borne on these papers from attempts at falsification by means of organic solvents. Moreover, these papers may be watermarked or may contain various artifices adapted to ensure recognition thereof.

In this way, the invention makes it possible to manufacture a white, non-fluorescent paper, sensitive to the oxidizing agent/reducing agent couple, which develops, in the presence of an attempted falsification by chemical means, colorations visible to the naked eye on this paper. The presence of these compositions does not lead to any appreciable modification in appearance nor reactivity of the papers already sensibilized by known techniques.

The paper forming the subject matter of the present invention may be printed by any one of the printing methods and may be used as handwriting support when it is desired that the writing be permanent and to discover possible attempts at falsification thereof. It is particularly interesting to apply it to the production of non-fluorescent hand-written pieces for payment such as cheques, Savings Certificates, Savings Books, official deeds, etc. . .

Although the majority of safety papers used are white, without departing from the object of the present invention, it may be envisaged to incorporate this means against falsification in a safety paper which is not white, but coloured. The starting products must not have a coloration which would substantially alter the colour of the paper. The iron(II) complex must have a colour preferably different from or at least more contrasted than that of the support.

The following Examples illustrate the invention without, however, limiting the scope thereof.

EXAMPLE 1

A paper support containing in mass iron(III) chloride at the rate of 0.015% by weight with respect to the weight of paper is impregnated in a bath containing an oxidized starch, sodium persulfate at the rate of 0.35% by weight and 2,2'-bipyridyl at the rate of 0.15% by weight so as to deposit, by 30% moisture regain, 0.045% by weight of this reagent with respect to the weight of paper. A paper is thus obtained, reacting to the "CORECTOR" for ink, as well as to the oxidizing agent/reducing agent couple applied under the following conditions (extremely severe test in the paper-making profession):

Immersion of the paper for 15 seconds in a 50 g/l solution of potassium permanganate.

Dewatering of the paper for 1 min.

Immersion of the paper in a 10–15 g/l solution of sodium bisulfite for the time necessary to decolorize the permanganate.

Drying in the open air.

The coloration obtained is a glaring pink coloration visibly with the shade of the starting paper.

The paper obtained also has the advantage of reacting to the reducing agents alone, such as bisulfite in aqueous solution at the rate of 10–15 g/l, yielding a pink reaction.

EXAMPLE 2

By proceeding as indicated in Example 1 and recycling in the mass from 5 to 10% of the preceding broken products, the whiteness and reactivity of the final product are not affected.

EXAMPLE 3

A support containing in mass an organo-soluble dye, iron(III) chloride at the rate of 0.015% by weight, is impregnated in an acid bath containing an oxidized starch, paranitrophenol, sodium persulfate at the rate of 0.35% by weight, and 2,2,'-bipyridyl at the rate of 0.15% by weight so as to have 30% of moisture regain.

The paper reacts to the test of Example 1 by taking a pink shade, as well as to the bases, erasers and organic solvents.

EXAMPLE 4

A paper support containing in mass iron(III) chloride at the rate of 0.015% is impregnated in a bath containing PVA and 2,2'-bipyridyl at the rate of 0.15% by weight so as to deposit by 30% moisture regain, 0.045% of this reagent with respect to the weight of the paper.

A paper is thus obtained, reacting to the "CORECTOR" for ink as well as to the oxidizing agent/reducing agent couple applied under the conditions of the test described in Example 1.

EXAMPLE 5

By proceeding as indicated in Example 4 and by recycling in the mass from 5 to 10% of preceding broken products, the final whiteness and reactivity of the final product are not affected.

EXAMPLE 6

A support containing in mass an organo-soluble dye, iron(III) chloride at the rate of 0.015% by weight with respect to the weight of paper, is impregnated in an acid bath containing PVA, paranitrophenol, 2,2'-bipyridyl at the rate of 0.15% by weight and manganese sulfate, so as to obtain 30% of moisture regain.

The paper reacts to the test of Example 1 by taking a pink shade, as well as to bases, erasers and organic solvents.

What is claimed is:

1. A non-fluorescent safety paper containing Fe(III) ions stabilized against reduction to Fe(II) ions from constituents of the paper with a sufficient amount of an oxidizing agent which prevents substantial reduction of Fe(III) to Fe(II) by the paper constituents, and a substantially colorless Fe(II) ions complexing agent which produces a strong permanent color in the presence of Fe(II) ions, said stabilized Fe(III) ions being present in sufficient quantity to form a sufficient amount of Fe(II) ions when exposed to a reducing source originating external to said paper to form a permanent visible color with said complexing agent.

2. The safety paper according to claim 1 wherein the substantially colorless Fe(II) ion complexing agent is 2,2'-bipyridyl.

3. The non-fluorescent safety paper of claim 1 wherein the complexing agent is orthophenatorine.

4. The non-fluorescent safety paper according to claim 1 which contains starch as a sizing agent.

5. The non-fluorescent safety paper according to claim 2 which contains starch as a sizing agent.

6. The non-fluorescent safety paper according to claim 3 which contains starch as a sizing agent.

7. The non-fluorescent safety paper according to claim 1 wherein the stabilizing oxidizing agent is sodium persulfate.

8. The non-fluorescent safety paper according to claim 2 wherein the stabilizing oxidizing agent is sodium persulfate.

9. A non-fluorescent safety paper according to claim 2 wherein the stabilizing oxidizing agent is sodium persulfate.

10. The non-florescent safety paper according to claim 3 wherein the stabilizing oxidizing agent is sodium persulfate.

11. The non-fluorescent safety paper according to claim 4 wherein the stabilizing oxidizing agent is sodium persulfate.

12. The non-fluorescent safety paper according to claim 5 wherein the stabilizing oxidizing agent is sodium persulfate.

13. The non-fluorescent safety paper according to claim 6 wherein the stabilizing oxidizing agent is sodium persulfate.

14. A non-fluorescent safety paper containing Fe(III) stabilized against reduction to Fe(II) ions, prior to the application to the paper of an external reducing agent, by a non-reducing sizing agent; and a substantially colorless Fe(II) ion complexing agent which produces a strong permanent color in the presence of Fe(II) ions, said stabilized Fe(III) ions being present in sufficient quantity to form a sufficient amount of Fe(II) ions when exposed to a reducing source originating external to said paper to form a permanent visible color with said complexing agent.

15. The non-fluorescent safety paper according to claim 14 wherein the non-reducing sizing agent is polyvinyl alcohol.

16. The non-fluorescent safety paper according to claim 1 wherein the fibrous composition of the paper comprises cellulosic fibers, synthetic fibers or a mixture thereof.

17. The non-fluorescent safety paper according to claim 14 wherein the fibrous composition of the paper comprises cellulosic fibers, synthetic fibers or a mixture thereof.

18. The non-fluroescent safety paper according to claim 11 wherein the fibrous composition of the paper comprises cellulosic fibers, synthetic fibers or a mixture thereof.

19. The non-fluroescent safety paper according to claim 12 wherein the fibrous composition of the paper comprises cellulosic fibers, synthetic fibers or a mixture thereof.

20. The non-fluorescent safety paper according to claim 15 wherein the non-reducing sizing agent is polyvinylalcohol and the substantially colorless Fe(II) ion complexing agent is 2,2'-bipyridyl or orthopenatorine.

* * * * *